United States Patent [19]

Ruffner

[11] Patent Number: 4,680,574

[45] Date of Patent: Jul. 14, 1987

[54] APPLIANCE ANTI-THEFT CIRCUITRY

[76] Inventor: Bryan J. Ruffner, 2818 N. 24th St., Arlington, Va. 22207

[21] Appl. No.: 717,128

[22] Filed: Mar. 22, 1985

[51] Int. Cl.[4] ..... G08B 13/14

[52] U.S. Cl. ..... 340/571; 340/687

[58] Field of Search ..... 340/571, 568, 687, 652, 340/659, 825.05, 825.63, 870.24, 512; 343/12 R, 13 R; 375/22

[56] References Cited

U.S. PATENT DOCUMENTS

| | | | |
|---|---|---|---|
| 3,423,747 | 1/1969 | Hogencamp | 340/571 |
| 3,425,050 | 1/1969 | Tellerman et al. | 340/571 |
| 3,732,562 | 5/1973 | Faber et al. | 340/512 X |
| 4,284,983 | 8/1981 | Lent | 340/568 |
| 4,327,360 | 4/1982 | Brown | 340/571 |

*Primary Examiner*—Glen R. Swann, III
*Assistant Examiner*—Thomas J. Mullen, Jr.

[57] ABSTRACT

The invention utilizes time domain reflectrometry to obtain a measure of the length of wire connecting an electrical appliance to its power distribution panel. An unauthorized change in this length is interpreted as an attempt to steal the appliance. Coded disabling keys are provided to allow an authorized user to unplug and move the appliance. The invention can be mounted within the appliance, requires no modification of the existing wiring or receptacles and is unaffected by power failures.

6 Claims, 5 Drawing Figures

APPLIANCE ANTI-THEFT CIRCUITRY

BACKGROUND OF THE INVENTION

The miniaturization of electronic components has resulted in a profusion of small, lightweight, expensive electrical appliances. Television sets, stereo equipment, and home computers are just a few of the appliances constituting a class of highly desirable, easily stolen, and easily resold merchandise. Historically, the motel industry has been the primary market for electrical appliance anti-theft devices. This market has now expanded to include a broad spectrum of residential and commercial applications, and will continue to grow in the foreseeable future.

The present invention is a theft protection device for electrical appliances. There has been a great deal of effort extended in this area. I have encountered over sixty related patents which I have grouped into six classifications: The first group uses modifications of the plug receptacle to detect an unplug condition. Usually a special box is connected between the appliance and the regular outlet. The removal of the appliance plug closes an alarm circuit. U.S. Pat. No. 3,484,775, issued to W. D. Cline on Dec. 16, 1969, is an example. This approach is subject to a number of problems. Most notably, a thief could cut the cord prior to stealing the device. Alternately, he cold pry loose the box from the wall and take it with him, without unplugging the unit. Because the alarm unit is exposed, the designer bears the full brunt of protecting it from destruction. A fair degree of protection can be obtained by embedding the device in the building structure, but only at significant cost.

The second approach involves setting up special wiring networks linking the device with a central monitoring area. U.S. Pat. No. 3,766,540, issued to Schapfer, et al., on Oct. 16, 1973, utilizes such a configuration. These networks require extensive wiring and generally cost more than the appliances they are designed to protect. It is important to attempt to make use of the standard wiring already installed or in use.

The third and fourth categories are AC power and motion detectors. These are often used in combination because, separately, they are especially prone to false alarms—the former due to power failures, the latter due to innocent vibrations. Roger S. Lent was issued U.S. Pat. No. 4,284,983 for such a combination Aug. 18, 1981. The combination is basically effective. It can be circumvented, however, by using an extension cord to keep the appliance powered while moving it. A common hundred foot extension cord would allow a thief to transport appliances from a building to a waiting truck with only minor inconvenience.

The fifth method, proposed in U.S. Pat. No. 3,423,747 issued to H. C. Hogencamp Jan. 21, 1969, combines a power sensing circuit with a loop utilizing the ground connection within the household wiring. The alarm connects to two separate grounding points and monitors the continuity of the resulting loop. The intent is to provide a second alarm criterion to distinguish power failures and thefts. The resulting combination becomes no more effective than the ground loop alone. The loop can be readily simulated by shorting the alarm leads together. The removal of the device will then be falsely interpreted as a power failure.

Finally, E. M. Tellerman, et al., in U.S. Pat. No. 3,425,050, issued Jan. 28, 1969, uses the continuity of a different loop. The ground and neutral or cold wire of standard household wiring are shorted together at the power distribution panel. Tellerman verifies the continuity of this loop as a method of determining if the appliance is plugged in. Unfortunately, this loop is subject to the same shorting constraints as the Hogencamp loop. A screwdriver held across the plug terminals will disable the alarm.

The device described in this patent also relies on the neutral to ground loop of the Tellerman device. Instead of checking for continuity, however, an actual measurement is made of the loop length using time domain reflectometry. A pulse is transmitted down the transmission line formed by these two wires and is reflected off the short at the distribution panel. The time required for the voltage pulse to drop to its steady-state zero voltage level is a function of the distance it must travel to reach the distribution panel. This time can be stored as a code known only to the alarm itself and compared to subsequent pulses. If the appliance is unplugged, the voltage pulse never encounters a short circuit and, therefore, never drops to a zero voltage level. The resulting pulse duration becomes infinite. Furthermore, any attempt to simulate the distribution panel with a new short will be detected by the change in loop length.

SUMMARY

Accordingly, it is an objective of the present invention to provide theft-protection circuitry for electrical appliances that is inexpensive, reliable, and resistant to false alarms.

A second object of this invention is the provision of an alarm system that is effective in notifying bystanders and neighbors of the attempted theft of a protected electrical appliance.

Another object is the provision of an alarm circuitry that is wholly contained within a protected electrical appliance that requires no modification to the standard three-wire outlet or wiring.

A further object is the provision of an alarm circuitry that operates all AC line power yet will continue to function in the event of a power failure.

A still further object is the provision of an alarm circuitry that will sound when a protected electrical appliance is unplugged.

A final object is the provision of a disabling code that will allow the protected device to be unplugged by authorized users.

DESCRIPTION OF THE INVENTION

Figure 1:
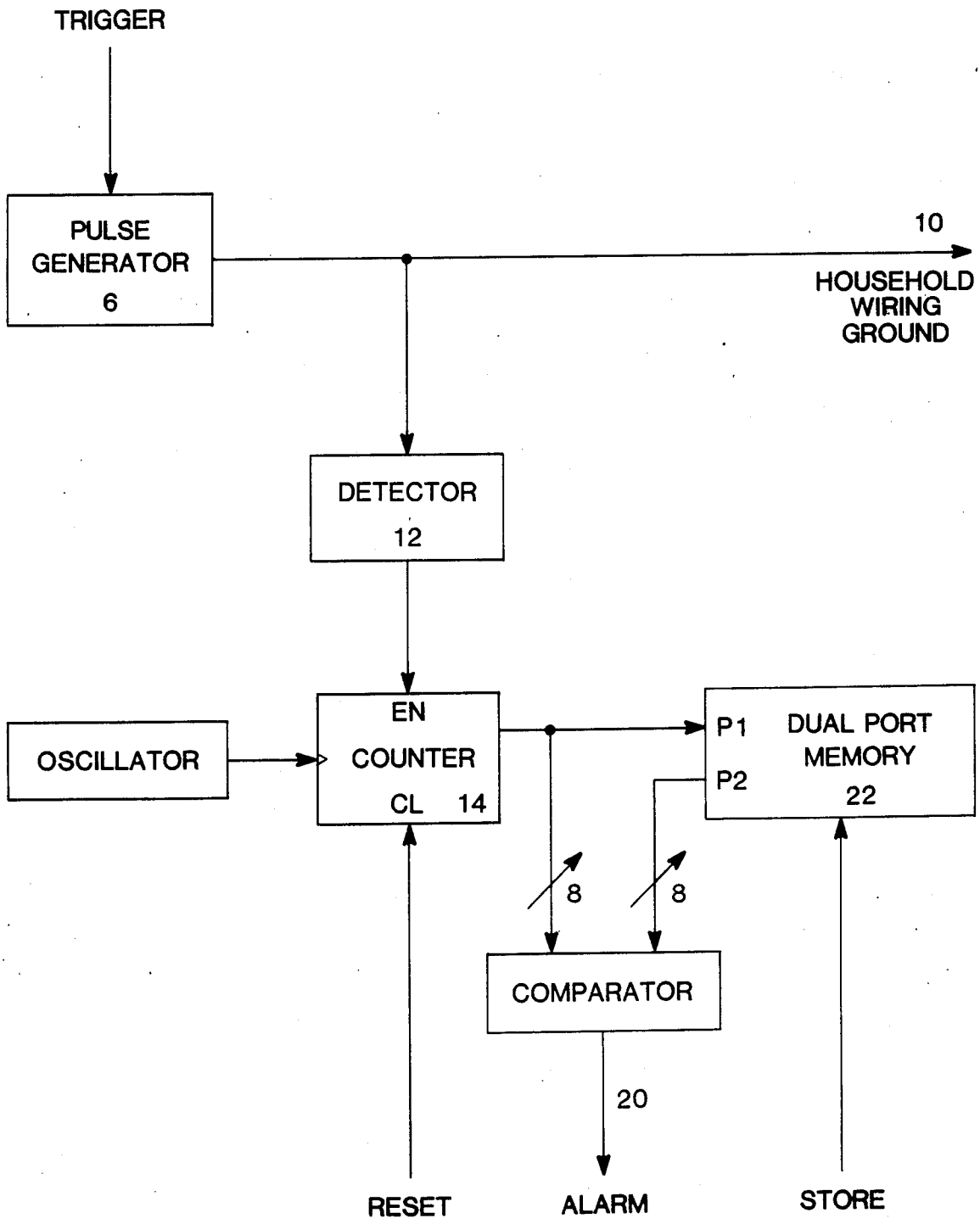
FIG. 1 is a block diagram of the basic alarm mechanism.
Figure 2:
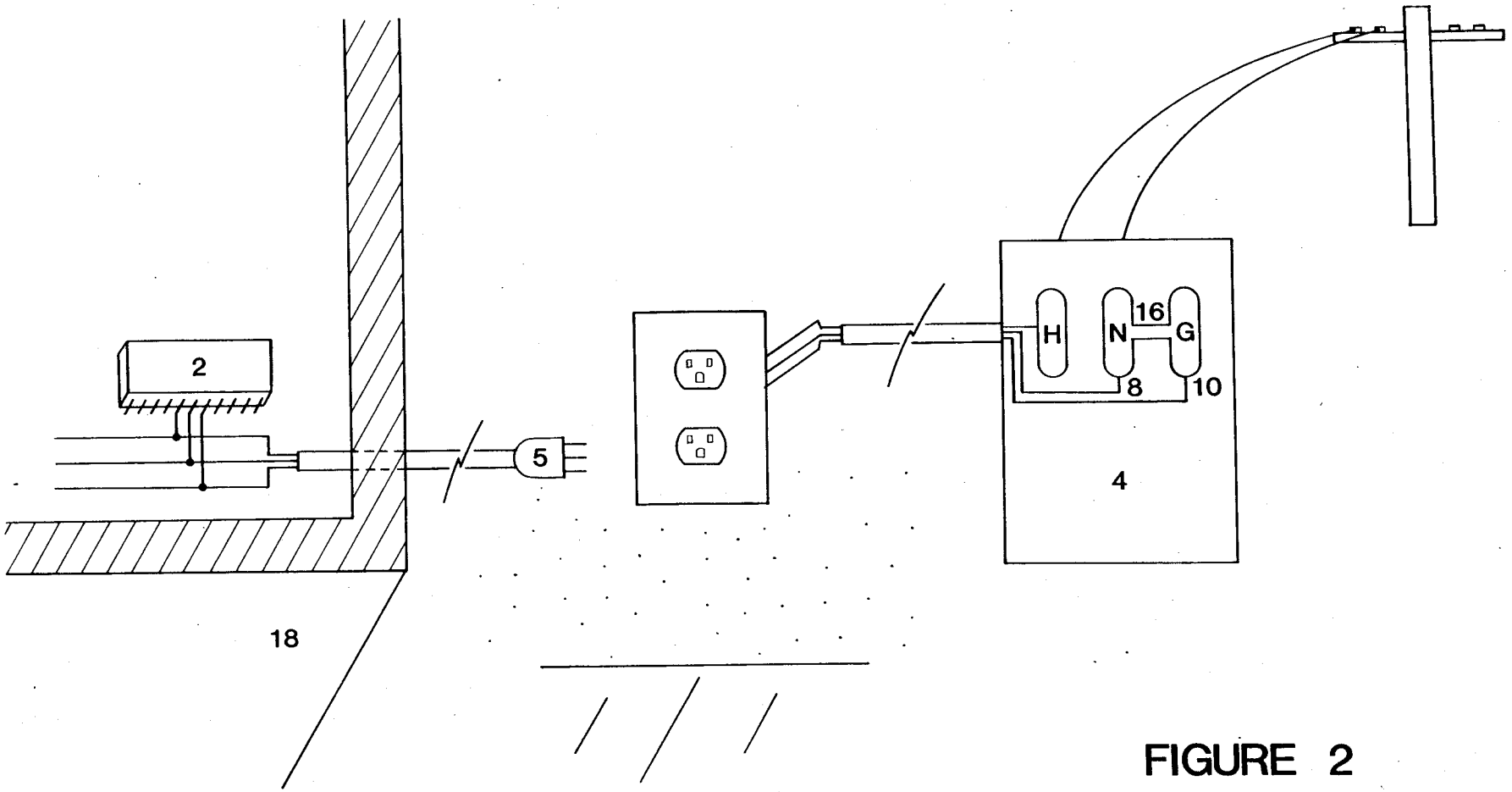
FIG. 2 depicts the interface of this invention with conventional wiring and receptacles.

FIG. 1 shows the basic circuitry for measuring the separation between the alarm 2 and the household power distribution panel 4 illustrated in FIG. 2. When triggered, pulse generator 6 sends a signal at the speed of light divided by a dielectric constant down the transmission line established by the neutral 8 and ground 10 wires of the household wiring. the creation of said pulse is detected by the pulse detector 12 which enables a high speed counter 14. The pulse will be partially reflected by interconnections and other changes in the characteristics of the transmission line as it travels toward the distribution panel 4. When reaching the panel 4, the pulse is inverted by short circuit 16 and sent back toward the alarm 2. The return of this inverted pulse, as well as the reflections caused by interconnections, will drive the voltage at the detector 12 toward its steady-state condition of zero volts. The time required for this transformation is a function of the distance of short circuit 16 from the appliance 18. When the voltage at the detector 12 drops below a present level, the high speed counter 14 is disabled and the count generated is compared with previous values. A significant deviation results in the generation of an alarm signal 20. The counter value used for comparison is updated periodically through dual port memory 22. Unplugging the appliance 18 removes the short circuit 16 from the end of the transmission line and replaces it with an open circuit at the plug terminals 5. When the traveling pulse encounters the open circuit, it is reflected positively and the resulting steady-state voltage is equal to the source voltage of the pulse generator 6. The detector 12 voltage remains above the present level for disabling high speed counter 14 and the counter value produced approaches infinity, generating an alarm signal 20.

FIG. 2 illustrates the path of the voltage pulse described in FIG. 1.

Figure 3:
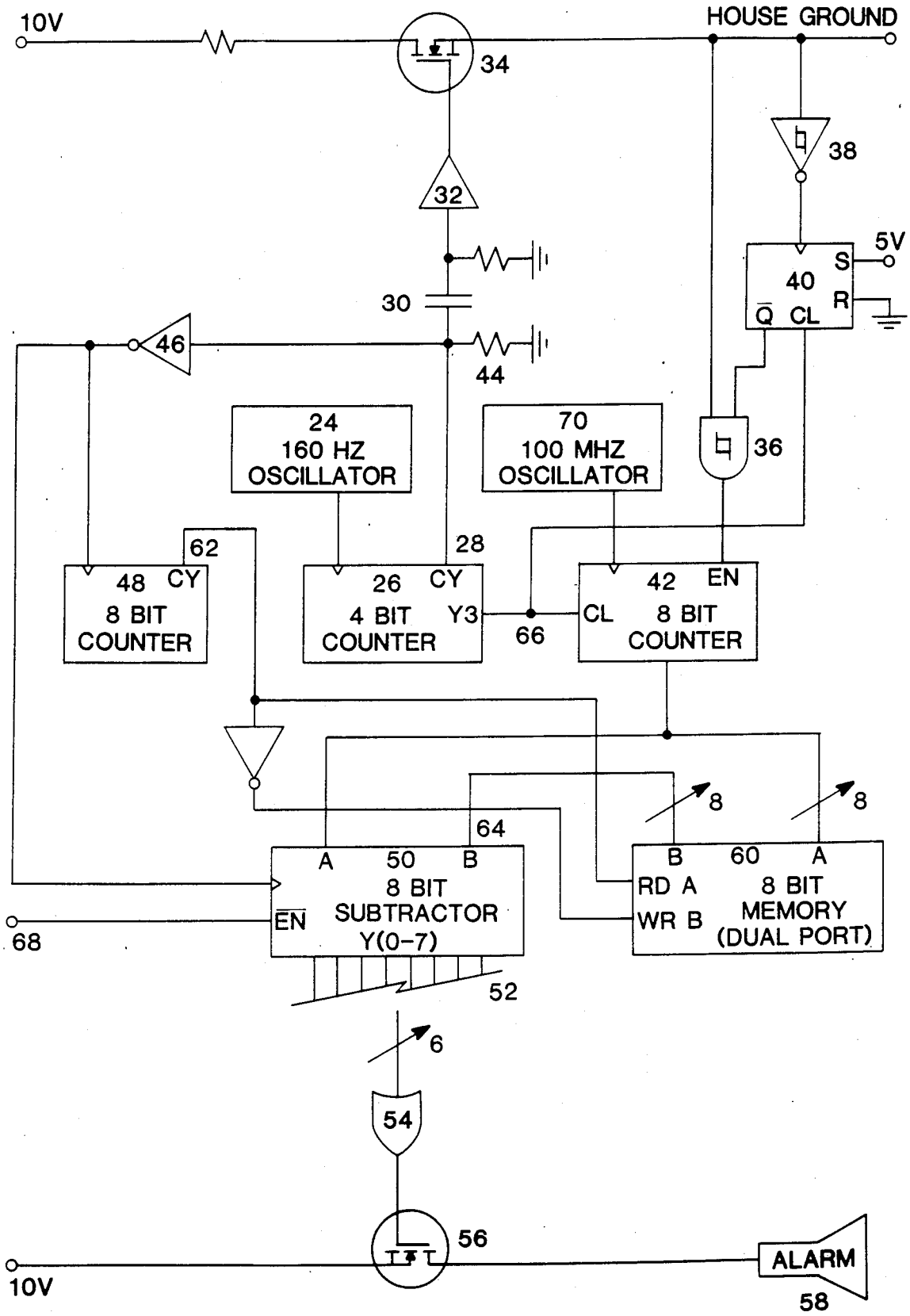
FIG. 3 shows the unplug detection circuitry.

FIG. 3 is a schematic of the FIG. 1 block diagram. 160 Hz oscillator 24 establishes the cyclical timing for pulse generation. An arbitrarily picked value of 0.1 seconds is used for the interval between pulses. The four-bit counter 26 will cycle through its range ten times every second when driven by oscillator 24. For one clock period each cycle, the carry bit 28 will shift to a logic high state. Uncharged capacitor 30 must initially transmit the high state to buffer 32. The buffer 32 is chosen to have a low source impedance driving power field effect transistor 34. This low impedance aids the device in quickly charging the gate capacitance of the transistor 34. The turn-on time of transistor 34 depends on the time constant associated with charging these gate capacitances. A rapid turn-on time is a key factor in transmitting the pulse. If the transistor 34 is still turning on after the approximate half-microsecond required for the distribution panel 4 reflection to return, the Schmitt trigger detectors 36 and 38 may never register a high-level input. Avoiding this problem, transistor 34 provides a sharp leading-edge pulse that raises one input of Schmitt trigger AND gate 36 to a high level. The RS flip-flop 40 has been previously cleared, thus its inverted output is high. Therefore the received pulse at AND gate 36 enables counter 42. Simultaneously, Schmitt trigger inverter 38 goes low. As the pulse voltage decays, the detector 36 and 38 output levels remain fixed until the voltage passes the 0.8 V low level threshold. The AND gate 36 then disables counter 42, while the low to high transition of inverter 38 clocks in a low value for the inverted output of flip-flop 40. The purpose of flip-flop 40 is to ensure that secondary reflections of the transmitted pulse do not reenable the counter 42.

While the carry output 28 of counter 26 is still a logic one, capacitor 30 begins to charge, lowering the input to buffer 32. The RC time constant is chosen to turn off the buffer 32 after a period perhaps twice as long as the longest expected pulse duration, thus ensuring that the 10 V source is driving the low impedance ground 10 to neutral 8 loop for as short a time as possible. Besides representing a heat source and power drain, a lengthy pulse duration would be sufficient to trip any ground fault interupters protecting the circuit to which the appliance is connected. These GFI devices will not be affected by the submicrosecond intervals needed to measure the neutral to ground loop.

When bit 28 returns to a low state, capacitor 30 discharges through resistor 44. The output of inverter 46 goes high, incrementing counter 48 which stores the number of cycles between memory updates. It also clocks the eight bit subtracter 50 which measures the difference between the new count and the stored value. The lower two bits of the subtracter output 52 are ignored to allow for natural variations and inaccuracies in measurement. If a more significant bit is high, gate 54 turns on transistor 56, driving the audible alarm 58. The carry output of counter 48 determines whether the dual port memory 60 is reading or writing data. Normally the carry bit 62 is low, directing memory to output its stored data to port B 64, of the subtracter 50. After 256 pulse cycles, however, the carry bit 62 switches high, causing memory 60 to read and store the current value of counter 42. In this way the count is periodically updated to account for long term variations such as oscillator frequency drift. The memory 60 has internal arbitration to ensure that it does not try to read and write at the same time during the carry-bit transition. The highest order bit 66 of the pulse timing counter 26 is linked to the clear inputs of counter 42 and flip-flop 40 to ensure that they are reset before a new pulse is transmitted.

An input 68 is provided to disable he subtracter 50, and thus the alarm, should the user wish to unplug his appliance. The subtracter output is low level when disabled. The logic for this disabling input 68 is developed in FIG. 4.

One obvious circuit enhancement would be a simultaneous power down of oscillators 24 and 70 when the alarm is disabled, thereby decreasing power usage to a minimum.

Figure 4:
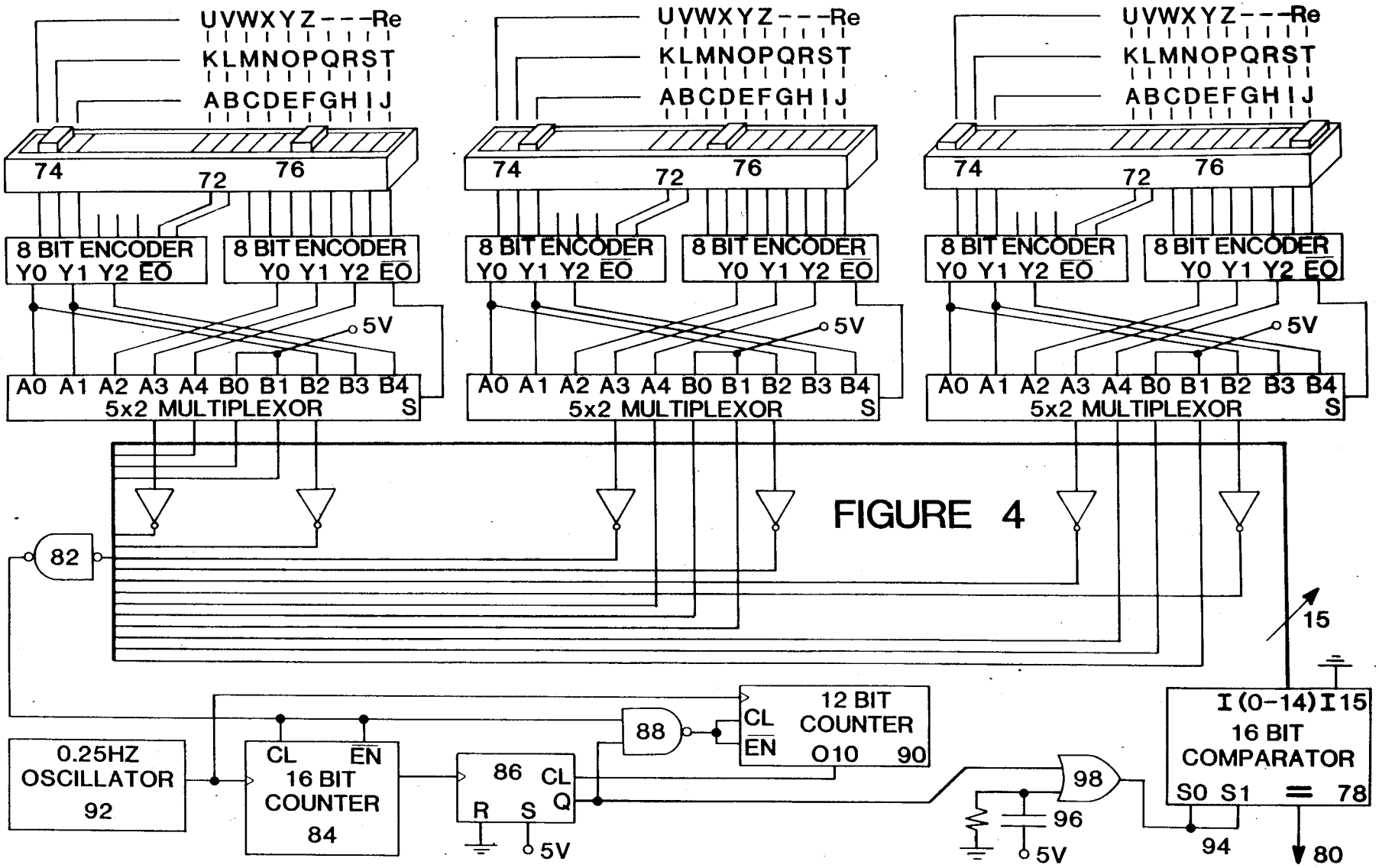
FIG. 4 illustrates the alarm-disabling circuitry.

In FIG. 4, the switches 72 allow the user to enter a three letter code. While the coding format is arbitrary, the three letter method is attractive because of its common usage and large number of permutations. The left slide bar 74 of each switch selects a row, while the right slide bar 76 picks a letter within that row. The three switches have thirty cubed or 27,000 permutations, and therefore need fifteen binary bits to be adequately represented. The encoders and multiplexors carry out the compression of thirty-nine switch lines into fifteen bit lines. Eight of the ten righthand lines are encoded into three bits. Similarly, the three lefthand lines are also directly encoded into two bits, with one leftover value. This extra value is hardwired on multiplexor pins B0 and B1 and is used to encode the two bits leftover from the right-hand bank. When one of these leftover bits is selected, the right hand encoder has no line selected. This causes line EO-inverted to go high, switching the multiplexor to bank B which is wired to process the two extra switch positions.

Figure 5:
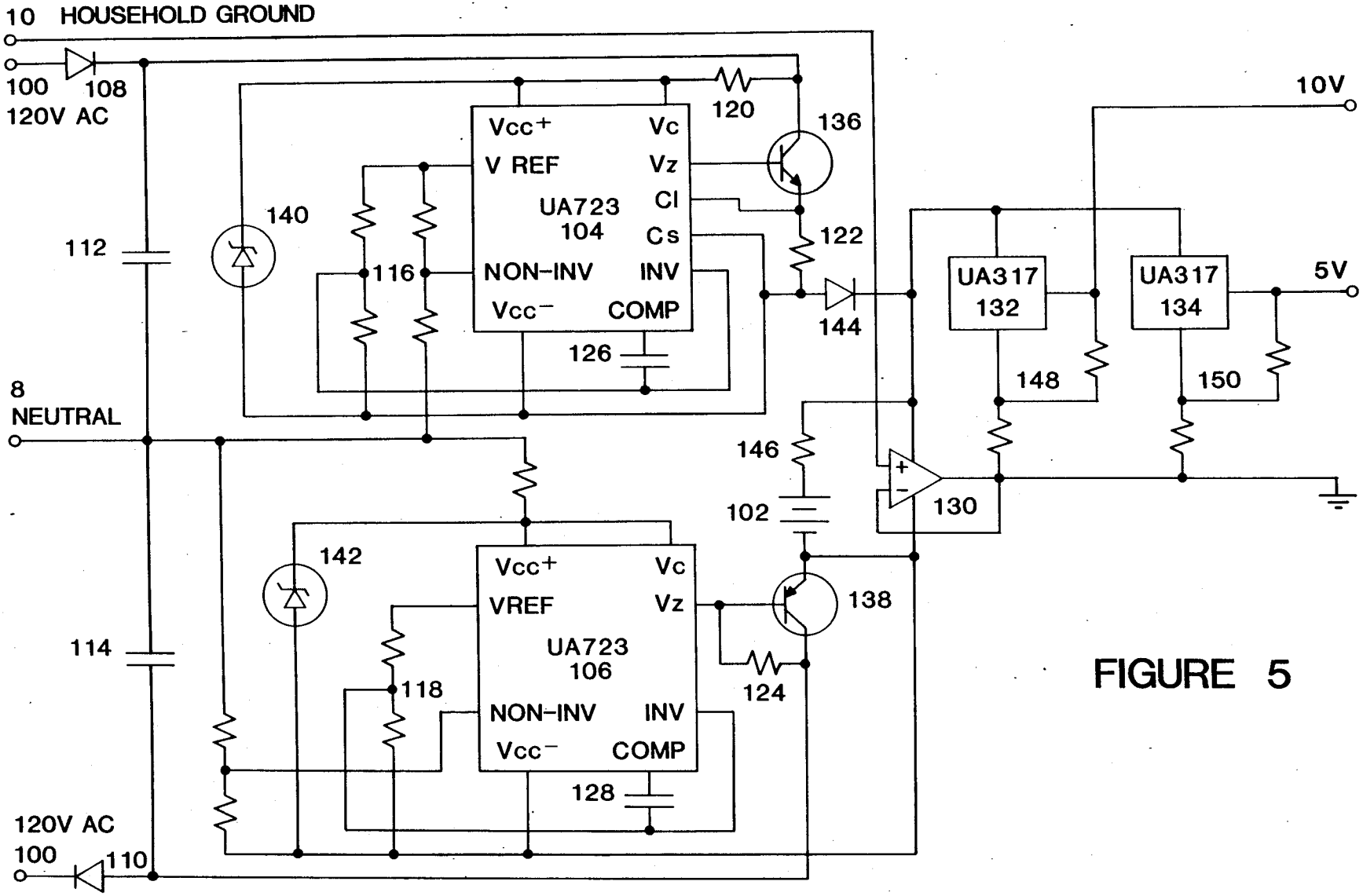
FIG. 5 is a schematic of the power-conditioning circuitry.

The fifteen coded enable lines are fed into a comparator 78 which checks them against a stored value. If they agree, line 80 goes high, disabling the alarm circuitry 68. Gate 82 is hardwired to detect when the switches are set to their reset position (RE). When this occurs, the normally high output of the NAND gate 82 falls, enabling a forty-eight hour counter 84. The intent of this circuitry is to allow a user who has either forgotten or decided to change his enable code to do so. He simply sets the switches to their reset position and leaves them there for at least forty-eight hours. The 48 hour figure is selected as a compromise between convenience and security. Should the switches be moved from their reset position prior to 48 hours, the counter 84 is cleared and disabled. Otherwise, after 48 hours, the carry bit of counter 84 is latched onto flip-flop 86. The resulting transmission of a high level to status bit S0 and S1 94 causes the comparator 78 to store the current value of enable switch encryption. A subsequent change in switch position causes a high output from NAND gate 82 that, in conjunction with the output of flip-flop 86, forces NAND gate 88 low, enabling counter 90. Driven by oscillator 92, it will take about one hour for bit 10 on counter 90 to shift high, at which point flip-flop 86 will be reset. Whatever code is on the input pins of the comparator 78 prior to the resetting of flip-flop 86 is the new enable code. The hour delay is designed to give the operator time to set the enable switches to a desired position. The resetting of flip-flop 86 returns NAND gate 88 to a high output state which, in turn, clears counter 90. The original enable code is stored upon power up because capacitor 96, which is initially uncharged, will take a finite period of time to charge, during which time the OR gate will have an high input. FIG. 5 shows the power supply circuitry. Line current 100 is the primary source with rechargeable batteries 102 providing backup. Floating regulators 104 and 106 in combination with power transistors 136 and 138 supply the basic positive and negative supplies. Any standard power rectification and regulation method could be used here provided it allows for referencing the alarm ground to the household ground 10 even in the event of a power failure. Diodes 108 and 110 and capacitors 112 and 114 provide half-wave rectification. Resistors 116, 118, 120, 122, and 124 and capacitors 126 and 128 are standard biasing components for the UA723. Diodes 140 and 142 maintain the regulators 104 and 106 within their maximum voltage ratings. Voltages of positive and negative fifteen volts are fed to operational amplifier 130. While the ground 10 and neutral 8 wires of the household wiring are at the same potential at the distribution panel 4, they may vary by as much as a volt or more at the appliance 2 due to series resistance drops from current flowing in the neutral wire. To maintain a consistent pulse amplitude, the op amp 130 tracks this differential and adjusts the system ground voltage to offset it. Regulators 132 and 134 provide the two supply voltages needed for the system. Resistors 148 and 150 set the regulator voltage levels. Rechargeable battery 102 is trickle charged through resistor 146. In the event of a power failure, diode 144 becomes back-biased and battery 102 supplies power to the system.

The union of the actual theft detection circuitry with disabling and power supply circuitry forms a basic theft protection system. Security would be broadly enhanced by the addition of transmission circuitry to convey alarm messages to neighboring homes or other responsive areas. Since this is a common enhancement in home security systems that involves established design techniques, it has not been thought necessary to discuss such circuitry for this application. The described system could easily be mounted within the protected unit where the thief would have difficulty disabling it without simultaneously destroying the desired appliance. The type of alarm transmission system used would affect the degree of protection required for the circuitry. Furthermore, while reference has been made throughout to household wiring, the same ideas hold for any institutional structures with similar wiring arangements. There are an unlimited number of ways of implementing the above circuitry—most notable, perhaps, being the use of a microprocessor as a substitute for hardwired logic. The above description shall not be construed as limiting the ways in which this invention may be practised, but shall be inclusive of many other variations that do not depart from the broad interest and intent of the invention.

Having thus described my invention, I claim:

1. An alarm device for detecting the removal of an electrical apparatus when plugged into a three-terminal power-supply outlet having a hot terminal and electrically interconnected neutral and grounded terminals where said alarm device comprises:

circuitry for cyclically applying a voltage across said neutral and grounded terminals;

circuitry for timing the return of an inverted electrical reflection of said applied voltage caused by the point of interconnection of said interconnected neutral and grounded terminals;

circuitry for electrically storing the measured time of said inverted electrical reflection;

circuitry for comparing a stored value of said measured time with subsequent values of said measured time;

and circuitry for generating an alarm signal when a stored value of said measured time and a subsequent value of said measured time differ by more than a predetermined amount.

2. The alarm device of claim 1 further comprising circuitry for generating a code to disable said alarm signal.

3. The alarm device of claims 1 or 2 further comprising circuitry for converting the energy from said power supplying into a form usable by said alarm device.

4. The alarm device of claim 3 further comprising a battery and circuitry for providing energy usable by said alarm device in the absence of energy from said power supply.

5. The method of detecting changes in the distance of an electrical apparatus from its power distribution panel when said panel is wired with a standard hot, neutral and grounded wire arrangement with said neutral and grounded wires shorted together at said panel so as to present a continuous low impedance loop at the terminals of said apparatus where said method comprises:

the repetitious transmitting of a voltage pulse over the transmission line formed by said neutral and grounded wires;

the timing of the return of an inverted electrical reflection of said voltage pulse caused by said short at said panel;

the electrical storing of the measured time of said inverted electrical reflection;

the comparing of a stored value of said measured time with subsequent values of said measured time;

and the generating of an alarm signal when a stored value of said measured time and a subsequent value of said measured time differ by more than a predetermined amount.

6. The method of claim 5 further comprising the generating of a code to disable said alarm signal.

* * * * *

UNITED STATES PATENT AND TRADEMARK OFFICE

CERTIFICATE OF CORRECTION

PATENT NO. : 4,680,574

DATED : July 14, 1987

INVENTOR(S) : Bryan J. Ruffner

It is certified that error appears in the above-identified patent and that said Letters Patent is hereby corrected as shown below:

Column 2, line 41 that operates off AC line power yet will continue to

Column 2, line 67 wires of the household wiring. The creation of said pulse

Column 3, line 12 age at the detector 12 drops below a preset level, the

Column 3, line 24 age remains above the preset level for disabling high

Column 4, line 4 fault interrupters protecting the circuit to which the

Column 4, line 33

An input 68 is provided to disable the subtracter 50,

UNITED STATES PATENT AND TRADEMARK OFFICE

CERTIFICATE OF CORRECTION

PATENT NO. : 4,680,574

DATED : July 14, 1987

INVENTOR(S) : Bryan J. Ruffner

It is certified that error appears in the above-identified patent and that said Letters Patent is hereby corrected as shown below:

Column 5, line 25 powering up because capacitor 96, which is initially un-

Column 5, line 28

Fig. 5 shows the power supply circuitry. Line current

Column 6, line 4 institutional structures with similar wiring arrangements

Column 6, line 5

There are an unlimited number of ways of implement-

Signed and Sealed this

Third Day of November, 1987

*Attest:*

*Attesting Officer*

DONALD J. QUIGG

*Commissioner of Patents and Trademarks*